US009091164B2

(12) United States Patent
Surjaatmadja et al.

(10) Patent No.: US 9,091,164 B2
(45) Date of Patent: Jul. 28, 2015

(54) METHOD FOR PROVIDING STEP CHANGES IN PROPPANT DELIVERY

(71) Applicant: Halliburton Energy Services, Inc., Houston, TX (US)

(72) Inventors: Jim Basuki Surjaatmadja, Duncan, OK (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/365,749

(22) PCT Filed: Aug. 29, 2013

(86) PCT No.: PCT/US2013/057207

§ 371 (c)(1),
(2) Date: Jun. 16, 2014

(87) PCT Pub. No.: WO2015/030760

PCT Pub. Date: Mar. 5, 2015

(65) Prior Publication Data

US 2015/0101806 A1 Apr. 16, 2015

(51) Int. Cl.

| | |
|---|---|
| ***E21B 43/267*** | (2006.01) |
| ***C09K 8/80*** | (2006.01) |
| ***E21B 37/06*** | (2006.01) |
| ***E21B 43/25*** | (2006.01) |
| ***E21B 27/02*** | (2006.01) |
| ***E21B 33/068*** | (2006.01) |

(52) U.S. Cl.

CPC ..... *E21B 43/267* (2013.01); *E21B 27/02* (2013.01); *E21B 33/068* (2013.01); *E21B 37/06* (2013.01); *E21B 43/25* (2013.01)

(58) Field of Classification Search

CPC ..... E21B 43/267; E21B 43/26; C09K 8/80

See application file for complete search history.

(56) References Cited

U.S. PATENT DOCUMENTS

| | | | | |
|---|---|---|---|---|
| 5,765,642 | A | 6/1998 | Surjaatmadja | |
| 5,799,734 | A | 9/1998 | Norman et al. | |
| 7,451,812 | B2 * | 11/2008 | Cooper et al. | 166/250.1 |
| 8,104,539 | B2 | 1/2012 | Stanojcic et al. | |
| 2007/0193746 | A1 | 8/2007 | Brannon et al. | |

(Continued)

FOREIGN PATENT DOCUMENTS

WO 2015030760 A1 3/2015

OTHER PUBLICATIONS

International Search Report and Written Opinion for PCT/US2013/057207 dated May 26, 2014.

*Primary Examiner* — Catherine Loikith

(74) *Attorney, Agent, or Firm* — McDermott Will & Emery LLP; John W. Wustenberg

(57) ABSTRACT

A method of creating a step-change in proppant concentration in a fracturing fluid at a desired location within the conduit or wellbore of an oil or gas well includes connecting an in-line mixer at an end of a conveyance. The in-line mixer is then placed within a conduit proximate to the desired location, and a flow of a clean fluid is provided from an upper portion of the conduit past the in-line mixer and into a lower portion of the conduit. A proppant slurry is introduced into the conveyance and injected into the clean fluid from the in-line mixer to generate a first step-change from the clean fluid to a flow of a mixture of the proppant slurry and the clean fluid within the desired location.

21 Claims, 7 Drawing Sheets

(56) References Cited

U.S. PATENT DOCUMENTS

2011/0088915 A1 4/2011 Stanojcic et al.
2011/0272156 A1 11/2011 Johnson, Sr.
2012/0241153 A1 9/2012 Brannon et al.
2013/0105166 A1 5/2013 Medvedev et al.

* cited by examiner

METHOD FOR PROVIDING STEP CHANGES IN PROPPANT DELIVERY

BACKGROUND

The present disclosure relates generally to systems and methods for stimulating a wellbore and, more particularly, to an in-line mixer for mixing a concentrated proppant slurry with a fluid.

To produce hydrocarbons (e.g., oil, gas, etc.) from a subterranean formation, well bores may be drilled that penetrate hydrocarbon-containing portions of the subterranean formation. The portion of the subterranean formation from which hydrocarbons may be produced is commonly referred to as a "production zone." In some instances, a subterranean formation penetrated by the well bore may have multiple production zones at various locations along the well bore.

Generally, after a well bore has been drilled to a desired depth, completion operations are performed. Such completion operations may include inserting a liner or casing into the well bore and, at times, cementing the casing or liner into place. Once the well bore is completed as desired (lined, cased, open hole, or any other known completion), a stimulation operation may be performed to enhance hydrocarbon production into the well bore. Examples of some common stimulation operations involve hydraulic fracturing, acidizing, fracture acidizing, and hydrajetting. Stimulation operations are intended to increase the flow of hydrocarbons from the subterranean formation surrounding the well bore into the well bore itself so that the hydrocarbons may then be produced up to the wellhead.

In some applications, it may be desirable to individually and selectively create multiple fractures at a predetermined distance from each other along a wellbore by creating multiple "pay zones." In order to maximize production, these multiple fractures should have adequate conductivity. The creation of multiple pay zones is particularly advantageous when stimulating a formation from a wellbore or completing a wellbore, specifically, those wellbores that are highly deviated or horizontal. The creation of such multiple pay zones may be accomplished using a variety of tools, which may include a movable fracturing tool with perforating and fracturing capabilities or actuatable sleeve assemblies disposed in a downhole tubular, such as U.S. Pat. No. 5,765,642.

One typical formation stimulation process may involve hydraulic fracturing of the formation and placement of a proppant in those fractures. Typically, a fracturing fluid (comprising a clean fluid and the proppant) is mixed at the surface before being pumped downhole in order to induce fractures in the formation of interest. The creation of such fractures will increase the production of hydrocarbons by increasing the flow paths in to the wellbore.

Oftentimes well operators attempt to "pillar frack" the formation, which involves introducing pulses or plugs of proppant into the clean fluid cyclically, thereby providing the target production zone with a step-changed fracturing fluid. In theory, the step-changed fracturing fluid creates strategically placed proppant pillars within the fractured formation, thereby enhancing conductivity. Ideally, the transition from the clean fluid to a mixture of clean fluid and proppant is an abrupt or sharp step-change. However, conventional methods of mixing the proppant and clean fluid often result in a spreading of the transition between the clean fluid and the proppant, thereby leading to a gradual transition rather than the desired step-change.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
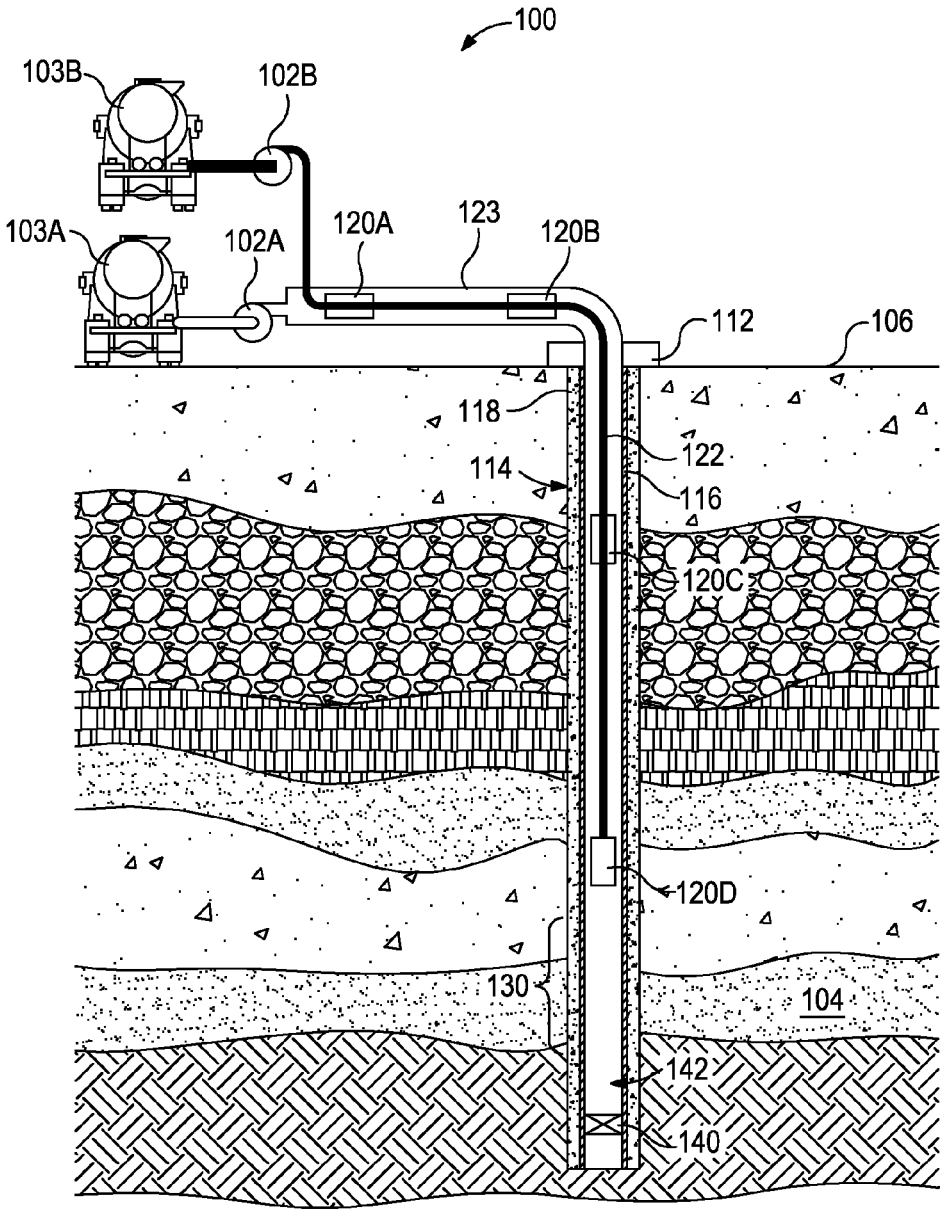
FIG. 1 illustrates a pumping system with one or more exemplary in-line mixers for mixing a proppant slurry and a clean fluid, according to one or more embodiments.

The present invention relates generally to systems and methods for stimulating a wellbore and, more particularly, to an in-line mixer for mixing a concentrated proppant with a clean fluid at the location of the desired step-change in composition.

The disclosed embodiments are directed to in-line mixing of a high-concentration proppant slurry with a clean fluid, in order to generate a fracturing fluid to be used for hydraulic fracturing operations. As discussed in more detail below, an in-line mixer may be used to mix the proppant and the clean fluid. In some cases, the in-line mixer can be arranged downstream from the pumping equipment at the surface. In other embodiments, the in-line mixer can be arranged at or near the wellhead of a well. In yet other embodiments, the in-line mixer can be arranged downhole at or adjacent a target zone of interest. At the in-line mixer, the heavily proppant-laden proppant slurry is injected or otherwise added into a flow of clean fluid in pulses or plugs in order to obtain desired step changes in proppant concentration. Sharp or abrupt step changes can result in effective pillar fracturing of a subterranean formation.

While the disclosed methods and apparatus are discussed in terms of an in-line mixer for use in an oil and/or gas well, the same principles and concepts may be equally employed for mixing of a first fluid carrying a suspended solid with a second fluid without a suspended solid. For example, the methods and apparatus of the present disclosure may equally be applied to other fields or technologies, such as the food industry in blending food products on a production line. In addition, the second fluid could also contain suspended solids, of a different type, such as including different size solids or even a different chemical composition. One preferred type of a solid might include solids that tend to degrade in time to provide a higher permeability in a subterranean fracture, for example.

As used herein, the phrase "proppant slurry" or variations thereof refer to a proppant-carrying fluid that is a mixture of a granular solid, such as sand, with a liquid, such as water or a gel. The proppant slurry may be any mixture capable of suspending and transporting proppant in concentrations above about 12 pounds of proppant per gallon of proppant slurry. The proppant slurry must have a proppant concentration that is the highest possible desired concentration of proppant in a mixture of proppant and clean fluid that might be needed during a particular job. In certain embodiments, the proppant slurry may contain up to 27 pounds of granular solid per gallon of fluid. In certain embodiments, the proppant slurry may also include other substances such as viscosity modifiers, thickeners, etc. In one exemplary embodiment, the proppant slurry may be LIQUIDSAND™ commercially available from Halliburton Energy Services, Inc., of Houston, Tex. and disclosed in U.S. Pat. No. 5,799,734.

In certain embodiments, the proppant slurry may comprise any water-containing fluid that does not adversely react with the subterranean formation or the other fluid constituents. For example, the fluid can comprise an aqueous mineral or organic acid, an aqueous salt solution such as potassium chloride solution, ammonium chloride solution, an aqueous organic quaternary ammonium chloride solution, or the like.

In certain embodiments, the proppant slurry may comprise a gelling agent that may comprise substantially any of the viscosifying compounds known to function in the desired manner. The gelling agent can comprise, for example, substantially any polysaccharide polymer viscosifying agent such as guar gum, derivatized guars such as hydroxypropylguar, derivatized cellulosics such as hydroxyethylcellulose, derivatives of starch, polyvinyl alcohols, acrylamides, xanthan gums, and the like. A specific example of a suitable gelling agent is guar, hydroxypropylguar, or carboxymethyl hydroxypropylguar present in an amount of from about 0.2 to about 0.75 weight percent in the fluid.

In certain embodiments, the proppant slurry may comprise a granular solid such as sized sand, resin-coated sand, sintered bauxite beads, metal beads or balls, ceramic particles, glass beads, polymer resin beads, ground nut shells, and the like. In certain embodiments, a portion of the proppant may be a bio-degradable material, so as to provide improved permeability. In certain embodiments, the bio-degradable portion may be 5-90% as designed by the user of the process.

As used herein, the phrase "clean fluid" or variations thereof refer to a fluid that does not have significant amounts of proppant or other solid materials suspended therein. Clean fluids may include most brines, including fresh water. The brines may sometimes contain viscosifying agents or friction reducers. The clean fluid may also be energized fluids such as foamed or comingled brines with carbon dioxide or nitrogen, acid mixtures or oil, based fluids and emulsion fluids. A clean fluid may be a liquid or a gas, such as $CO_2$ or $N_2$.

As used herein, the phrase "fracturing fluid," or variations thereof, refers to a mixture of a clean fluid and a proppant slurry in any proportion.

Within this document, a reference identifier may be used as a general label, for example "101," for a type of element and alternately used to indicate a specific instance or characterization, for example "101A" and 101B," of that same type of element.

FIG. 1 illustrates a pumping system 100 including one or more in-line mixers 120 (shown as mixers 120A, 120B, 120C, and 120D) used for mixing a proppant slurry and a clean fluid, according to one or more embodiments. It should be noted that, even though FIG. 1 depicts the pumping system 100 as being used with a land-based well system, it will be appreciated by those skilled in the art that the system 100, and various embodiments of the components disclosed herein, are equally well suited for use in other types of well systems, such as sea-based oil and gas drilling platforms, or rigs used in any other geographical location.

As illustrated in FIG. 1, a wellhead installation 112 is positioned on the ground surface 106 and, as depicted, a wellbore 114 extends from the wellhead installation 112 and has been drilled through various earth strata, including various submerged oil and gas formations 104. A casing string 116 is at least partially cemented within the main wellbore 114 with cement 118. The term "casing" is used herein to designate a tubular string used to line the wellbore 114. The casing may actually be of the type known to those skilled in the art as "liner" and may be segmented or continuous.

The well system 100 may further include a first pump 102A and a second pump 102B arranged at the surface and configured to pump fluids into a conduit 123 extending to the wellhead installation 112. The first pump 102A pumps a clean fluid derived from a first source 103A into the annulus of the conduit 123. As illustrated, the first source 103A may be a truck carrying a storage tank. In other embodiments, the first source 103A may be any fluid storage device, such as an integral portion of one or more manifold trailers, as known in the art. Pump 102A or 102B may consist of a plurality of pumps as needed in the process, as is known in the art.

The second pump 102B may be fluidly coupled to a conveyance 122 that extends within the conduit 123 such that the clean fluid pumped from the first pump 102A generally bypasses the conveyance 122 in the annulus defined between the conveyance 122 and the conduit 123 and subsequently in the annulus defined between the conveyance 122 and the wellbore 114. The conveyance 122 may be any fluid-carrying conduit including, but not limited to coiled tubing and drill pipe. The second pump 102B may be configured to pump a proppant slurry from a second source 103B into the conveyance 122. In certain embodiments, the conveyance 122 may deliver the clean fluid while the conduit 123 carries the proppant slurry.

In certain embodiments, one or both of the first and second sources 103A,B may be mounted on mobile platforms, such as trailers (not shown in FIG. 1). The clean fluid and the proppant slurry are provided separately to at least one of the in-line mixers 120A-D shown in FIG. 1. At the inline mixer 120A-D, the proppant slurry may be injected into and otherwise mixed with the clean fluid, as described further with respect to FIG. 2B below. The in-line mixers 120 are shown in FIG. 1 in four exemplary locations; the first in-line mixer 120A being arranged proximate to the pumps 102A,B; the second in-line mixer 120B being arranged proximate to the wellhead installation 112; the third in-line mixer 120C being arranged at a first depth from the surface 106 and within the wellbore 114; and the fourth in-line mixer 120D being arranged at or near a production zone 130 of the formation 104.

In some embodiments, only one of the in-line mixers 120A-D would be provided in a single location within the system 100. In other embodiments, however, two or more in-line mixers 120A-D may be arranged within the system 100. Moreover, those skilled in the art will readily appreciate that the in-line mixers 120A-D may be arranged at other locations not indicated in FIG. 1 within the system 100, without departing from the scope of the present disclosure. Accordingly, while operation of the fourth in-line mixer 120D is discussed below, with respect to its location identified in FIG. 1, it will be appreciated that the discussion equally applies to the other in-line mixers 120A-C located at their respective intermediate locations.

Figure 2A:
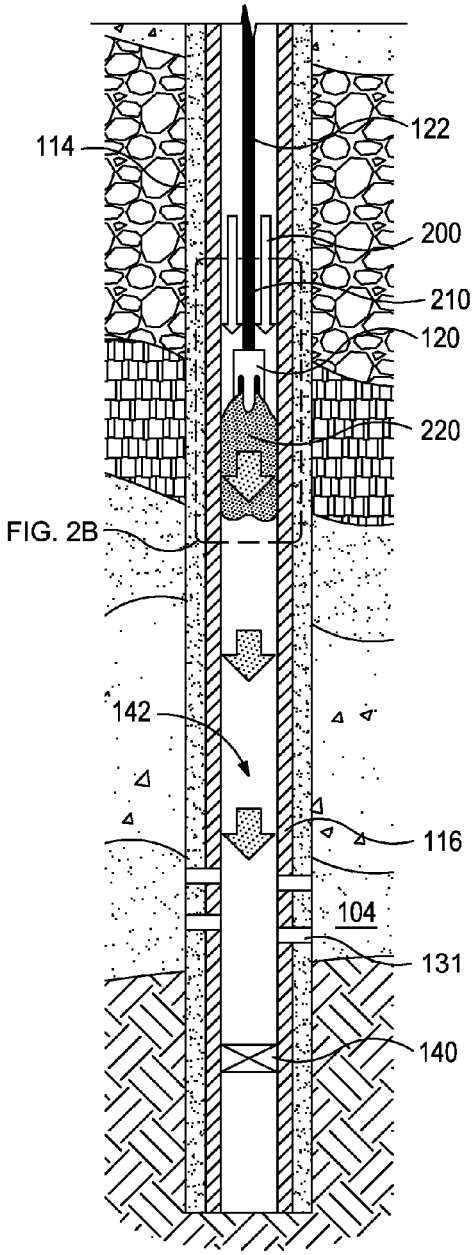
FIGS. 2A and 2B are enlarged views of one of the exemplary in-line mixers of FIG. 1, according to one or more embodiments.
Figure 2B:
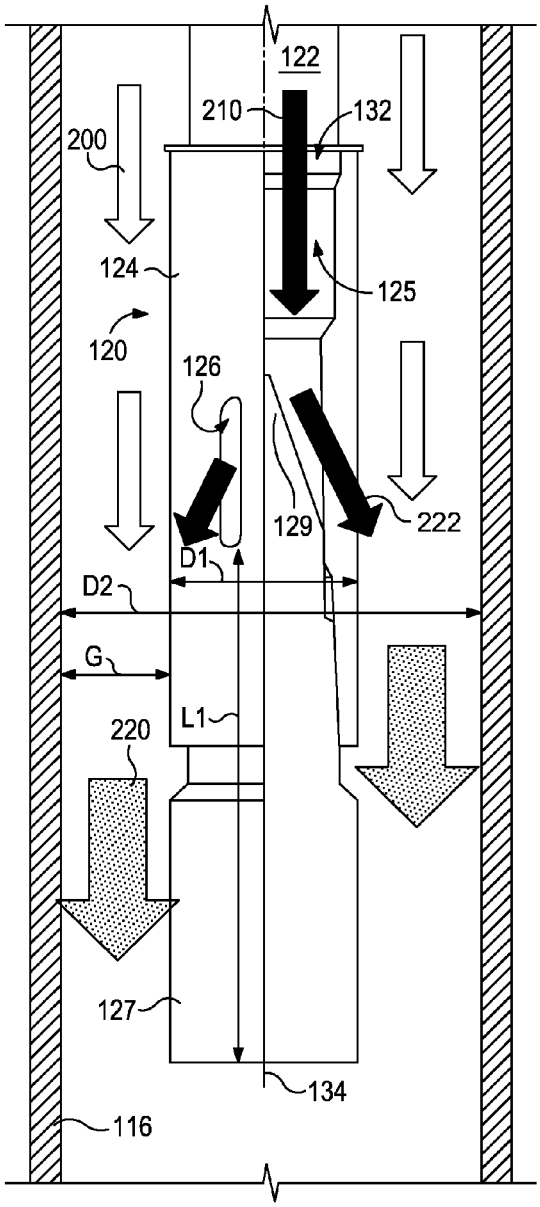

FIGS. 2A and 2B are enlarged partial cross-sectional views of the exemplary fourth in-line mixer 120D of FIG. 1 (shown as in-line mixer 120), according to one or more embodiments. In particular, the inline mixer 120 depicted in FIGS. 2A and 2B is arranged downhole within the wellbore 114 and substantially adjacent the formation 104 of interest. FIG. 2A depicts the flow of clean fluid 200 along the annulus 123 of the casing string 116 and advancing toward the in-line mixer 120. FIG. 2A also depicts the conveyance 122 through which proppant slurry 210 is flowing downward to the in-line mixer 120. A fracturing-fluid mixture 220 of the proppant slurry 210 and clean fluid 200 is visible flowing downward from the in-line mixer 120 and toward one or more penetrations 131 that extend from the open volume 142 within the wellbore 114 and through the casing string 116 and cement 118, thereby fluidly communicating the interior of the wellbore 114 with the formation 104.

A plug 140, such as a bridge plug, may be disposed within the interior of the casing string 116 below the formation 104 and thereby defining the open volume 142 thereabove. The plug 140 seals the wellbore 114 such that as the mixture 220 advances downward within the open volume 142, it is forced out through the penetrations 131 and into the surrounding formation 104. As discussed with respect to FIGS. 6A 6C, the mixing of the clean fluid 200 and proppant slurry 210 may occur very quickly such that the entire bore of the casing string 116 may be filled with the mixture 220 within a few feet of the in-line mixer 120.

In order to enhance conductivity of the resulting fractures in the formation 104, the flow of the proppant 210 may be pulsed or otherwise cyclically introduced into the clean fluid 200. As a result, alternating plugs of clean fluid 200 and the mixture 220 may be forced into the formation 104 on a predetermined basis. It is desirable that this cyclical transition between plugs of clean fluid 200 and the mixture 220 be abrupt and as sudden as possible, with the ideal profile of the corresponding plugs being a square-wave step-change. The advantages of this transition are discussed in greater detail with respect to FIGS. 3A-3C and FIG. 4.

FIG. 2B is an enlargement of the portion of FIG. 2A indicated by the dashed-line box labeled "FIG. 2B". The various flows of clean fluid 200, proppant slurry 210, and the mixture 220 are indicated by corresponding white, black, and shaded arrows, respectively. The body of the inline mixer 120 is shown in partial cut-away, wherein the left side is an exterior view and the right side is a cut-away view showing an upper portion 124 with an internal cavity 125 having a plurality of slots 126 extending through the body of the in-line mixer 120. The proppant slurry 210 is delivered into the internal cavity 125 from the conveyance 122 through inlet 132 while the clean fluid 200 flows past the lateral exterior surfaces of the in line mixer 120. An end cap 127 is partially disposed within the internal cavity 125 of the upper portion 122 and has a tip 129 that guides the proppant slurry 210 flowing downward through the internal cavity 125 out through the slots 126. In certain embodiments, the tip 129 is conical and shaped such that its conical surface is positioned at the upper portion 124 at a point proximate to the slots 126. As a result, in at least one embodiment, the in-line mixer 120 may be configured as a type of jetting tool used to eject the proppant slurry 210 at a high velocity.

In certain embodiments, the portion of the end cap 127 that extends into the internal cavity 126 may exhibit other shapes, for example a truncated cone or a cylinder. The mixing of the proppant slurry 210 and the clean fluid 200 that is induced by the jetting of the proppant slurry 210 outward through the slots 136 is discussed in greater detail with respect to FIGS. 6A-6C. In certain embodiments, the body has a central axis 134 and the slots 126 and tip 129 cooperate to direct fluid flowing out through the slots 126 in a direction that is both radially outward and axially downward with respect to the central axis 134, as shown by the arrow labeled "222" in FIG. 2B.

Although the exemplary in-line mixer 120 is shown as a static mixer with slots 126 that introduce the proppant slurry 210 into the flow of clean fluid 200, various types and designs of in-line mixers with other types of mixing features may equally be used, without departing from the scope of the disclosure. In certain embodiments, for instance, the in-line mixer 120 may include active elements, such as one or more spinning blades that actively blend the clean fluid and the proppant slurry. In other embodiments, the in-line mixer 120 may include passive elements, such as a series of alternating static blades that receive both flows of the clean fluid 200 and the proppant slurry 210 and sequentially split and redirect the flows of the proppant slurry 210 and the clean fluid 200 so as to intermix the two flows. In yet other embodiments, an exemplary in-line mixer can be placed within a conduit through which is flowing a first material and accept a separate flow of a second material and mix the first and second materials such that the flow within the conduit downstream of the device is a generally uniform mixture of the first and second materials.

Figure 2C:
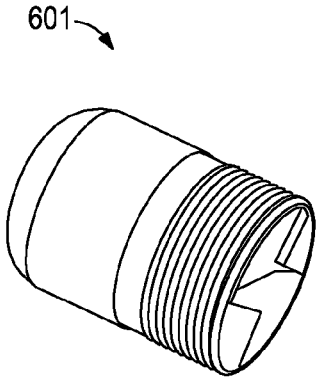
FIGS. 2C and 2D are two views of another embodiment of a mixer, according to one or more embodiments.
Figure 2D:
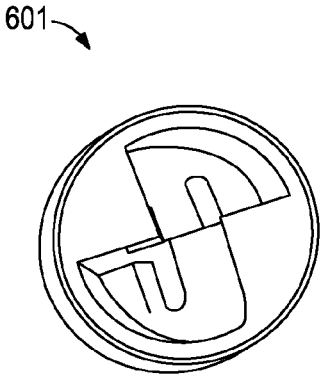

FIGS. 2C and 2D are two views of another embodiment of a mixer 601, according to one or more embodiments.

Figure 2E:
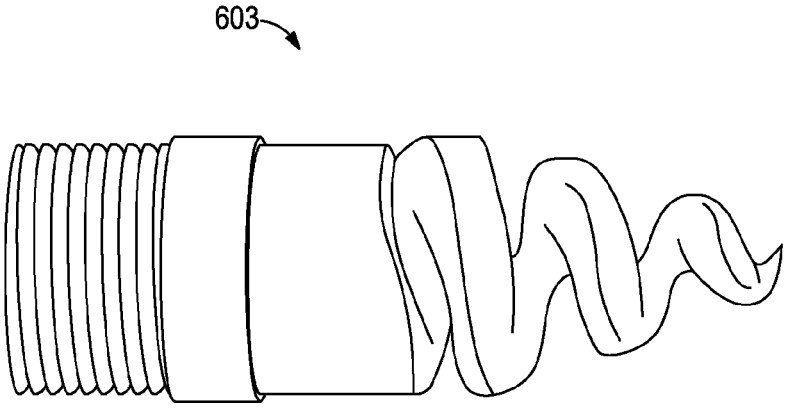
FIG. 2E depicts another embodiment of a mixer, according to one or more embodiments.

FIG. 2E depicts another embodiment of a mixer 603, according to one or more embodiments. The mixer 603 comprises a tapered, spiral feature to enhance mixing.

Figure 2F:
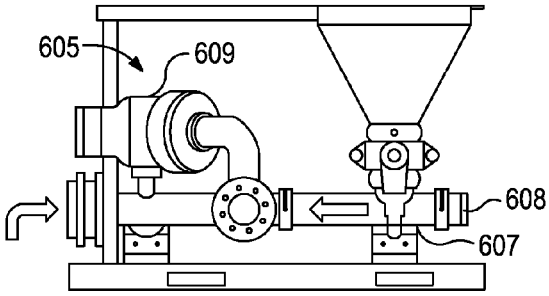
FIGS. 2F and 2G are a side view and a cutaway top view of another embodiment of a mixer, according to one or more embodiments.
Figure 2G:
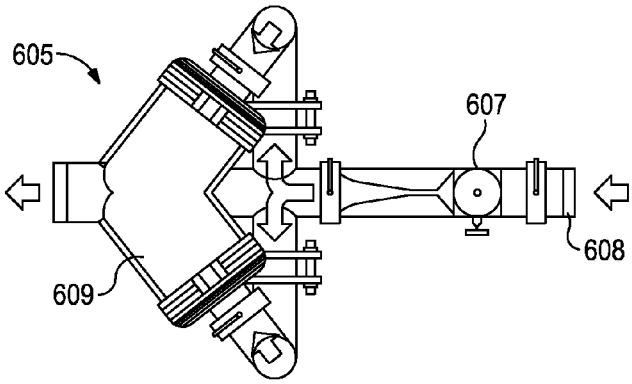

FIGS. 2F and 2G are a side view and a cutaway top view of another embodiment of a mixer 605, according to one or more embodiments. The proppant slurry is introduced at the eductor 607 into the flow of clean fluid entering the inlet 608 and the stream is divided then re-combined at an angle in a jet-mixer 609.

Figure 2H:
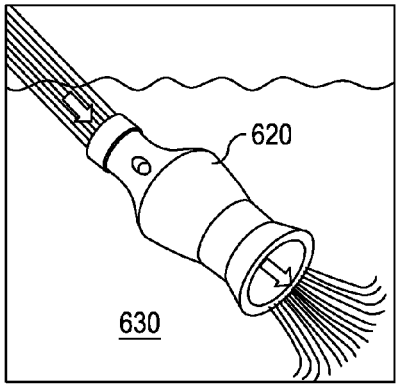
FIGS. 2H and 2J are a perspective view and cutaway side view of another embodiment of a mixer, according to one or more embodiments.
Figure 2J:
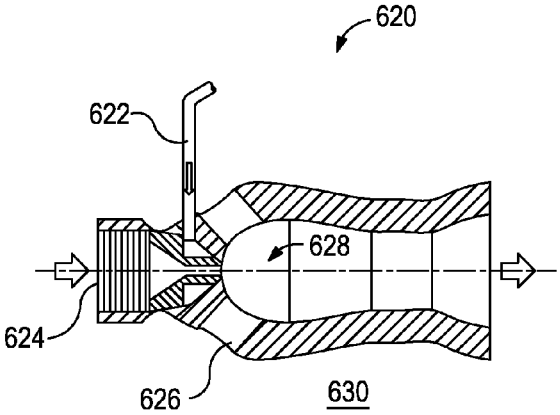

FIGS. 2H and 2J are a perspective view and cutaway side view of another embodiment of a mixer 620, according to one or more embodiments. The mixer 620 may immersed in a local fluid 630 and provided with a gas through an "air tube" 622 and a first material through an inlet 624, as may be assisted by a flow of gas through the air tube 622, wherein the local fluid 630 is drawn in through the helical fluid inductors 626 and mixed with the first material in the mixing chamber 628.

Figure 3A:
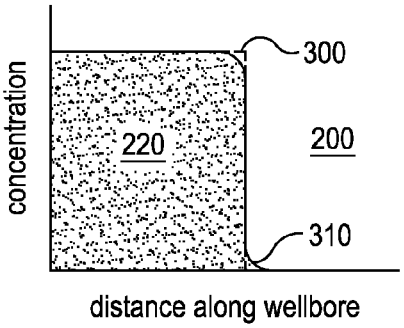
FIGS. 3A-3C are a graphical representation of the interface profile of a mixture of proppant slurry and clean fluid as it travels down a wellbore.
Figure 3B:
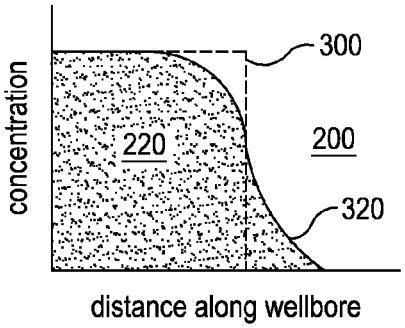
Figure 3C:
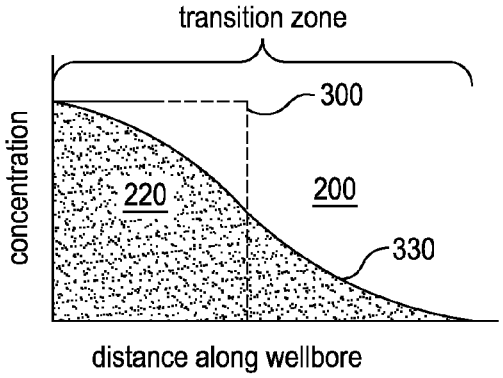

Referring now to FIGS. 3A-3C, with continued reference to FIGS. 2A and 2B, illustrated are graphical representations of exemplary interface profiles of a mixture 220 of proppant slurry 210 and clean fluid 200 as it travels from an in-line mixer 120 (FIGS. 2A-2B) within the wellbore 114 (FIG. 1). Each figure shows a concentration of the contents of the pipeline plotted against a local length of the wellbore 114. The clean fluid 200 is considered to have substantially zero concentration of proppant suspended therein and the mixture 220 is considered to have an arbitrary high concentration of proppant that is equal to the plateau on each plot. For reference, the horizontal and vertical scales of FIGS. 3A-3C are identical.

Without being bound by theory, FIG. 3A is a plot of the concentration along a portion of the wellbore 114 that is at or near the surface 106 and just below an in-line mixer (e.g., the in-line mixer 120A-D of FIG. 1). The plot of FIG. 3A reflects the concentration of proppant at a time just after a flow of the proppant slurry 210 has been initiated into the clean fluid 200 and mixed completely to become mixture 220. As depicted, as the mixture moves down to the intended zone, there is a desired or ideal step-change 300 between the clean fluid 200 and the mixture 220, and an actual step-change 310 between the clean fluid 200 and the mixture 220 as it enters the target zone. The actual step-change 310 may be substantially a square-wave step-change at this point in the wellbore, with small, non-square transitions evident at the "corners" of the ideal step-change profile 300. This profile will advance downward in the wellbore as pumping continues.

FIG. 3B is a time-lapsed plot of the interface of FIG. 3A after pumping has displaced the interface downward to a certain depth, for example 3000 feet, in the wellbore. Circulation effects and flow eddies, for example, caused by the viscous friction with the wall of the wellbore, have dispersed some of the proppant from the mixture 220 into the clean fluid 200 that is ahead of/below the flow front. The actual transition 320 in concentration now occurs over a longer local length of the wellbore.

FIG. 3C is a plot of the interface of FIG. 3A after pumping has displaced the interface further downward to a target depth, for example 10,000 feet, in the wellbore. Continued circulation effects and flow eddies have further dispersed some of the proppant from the mixture 220 into the clean fluid 200 that is ahead of/below the flow front, spreading the actual step-change 330 over an even greater length of the local wellbore than has occurred at the lower depth, shown in FIG. 3B. It can be seen that while the actual step-change 310 at the surface, as shown in FIG. 3A, may have been a near square-wave step-change 300, the actual step-change 330 at depth is far from the desired step-change profile 300.

Figure 4:
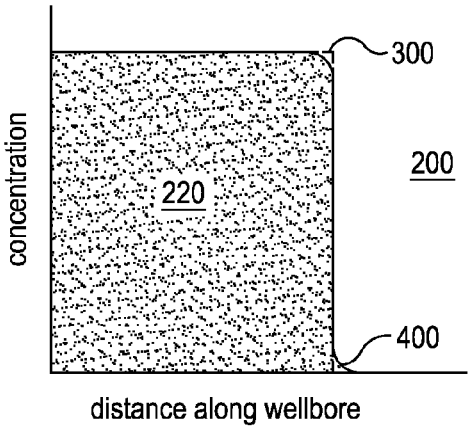
FIG. 4 is a graphical representation of the interface profile of a mixture of proppant slurry and clean fluid when mixed by an in-line mixer at the target depth of the wellbore, according to one or more embodiments.

Referring now to FIG. 4, with continued reference to FIGS. 2A-2B and 3A-3C, depicted is a graphical representation of an interface profile 400 of a mixture 220 of proppant slurry 210 and clean fluid 200 when mixed by an in-line mixer 120 at or near the target depth of a wellbore (e.g., the fourth in-line mixer 120D of FIG. 1), according to one or more embodiments. As the proppant slurry 210 and the clean fluid 200 are kept separate above the in-line mixer 120 and mixed by the in-line mixer 120 only after reaching the target depth, which may be just above the penetrations 131 as shown in FIG. 2A, the profile of the flow front of the mixture 220 reaching the penetrations 131 may be very close to the ideal step change profile 300.

The proppant slurry 210 may be formulated such that the high-solids content of granular solids is retained in a fluidized state without significant settling during the periods in which the proppant slurry 210 is static; i.e., not flowing through a conduit. When a flow of the proppant slurry 210 through a conduit abruptly stops, the granular solids remain in suspension within the conduit. Thus, if a first end of a conduit that is filled with the proppant slurry is connected to an in-line mixer 120, the act of introducing a step-change in flow, for example from a flow rate of zero to a flow rate of a determined value, of the proppant slurry 210 into a second end of the conduit will cause a near-identical step-change in the flow of the proppant slurry 210 from the conduit into the mixer 120.

Starting and stopping a flow of the proppant slurry 210 into the second end of the conduit may result in a "slug" of the mixture 220 of the proppant slurry 210 and the clean fluid 200 to travel down the conduit below the in-line mixer 120. In addition, making a step-change in the flow rate of the proppant slurry 210, for example changing from a flow rate of X gallons per minute to a flow rate of 1.2(X) gallons per minute, creates a step change in the flow rate at the in-line mixer 120 that results in a step-change in the concentration of the proppant slurry 210 within the mixture 220.

To facilitate a better understanding of the present disclosure, tests of exemplary embodiments using in-line mixers were undertaken by the inventors and are described below. In no way should the following description be read to limit, or to define, the scope of the disclosure.

Figure 5:
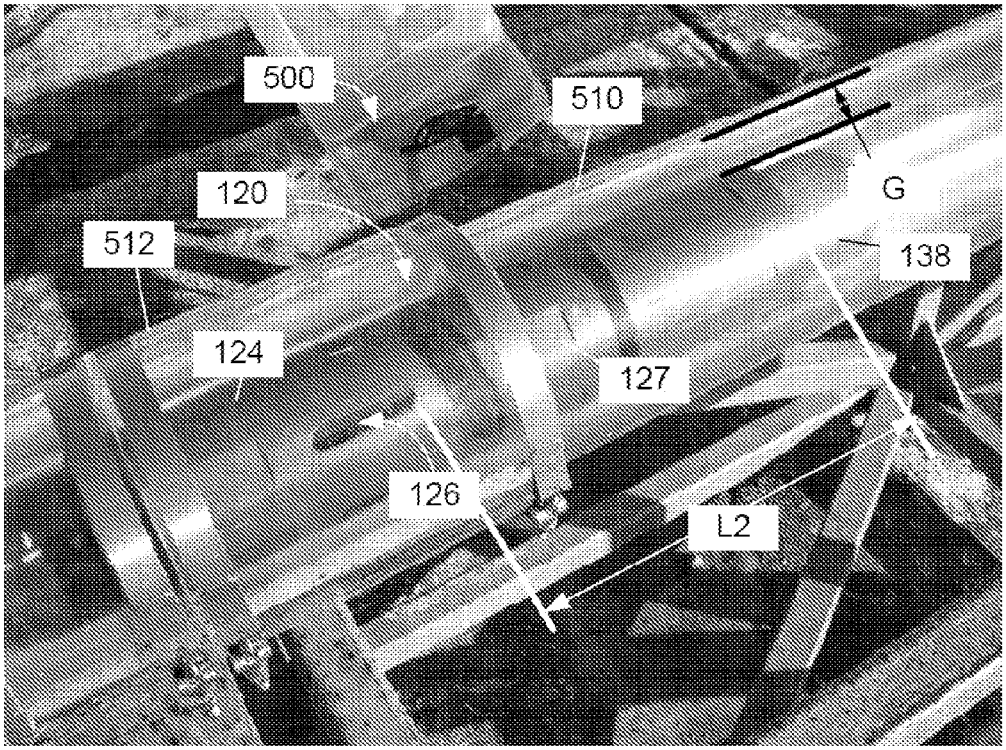
FIG. 5 is a photograph of a test system for an embodiment of at least one of the disclosed in-line mixers, according to one or more embodiments.

FIG. 5 is a photograph of a test system 500 for an embodiment of the disclosed in line mixer 120, according to one or more embodiments. A clear test pipe 510 simulates the casing string 116 of FIG. 1 and allows visibility of fluid flowing within the test pipe 510. Fluid flows from left, equivalent to the uphole direction, to right, equivalent to the downhole direction in this view. The in-line mixer 120 is positioned with the upper portion 124 disposed within a joint of the test pipe 510 and overlaid with a larger diameter coupler 512, secured with steel bands, to allow easy access to the in-line mixer 120 while the end cap 127 is disposed within the test pipe 510 itself. The inner diameter of the test system 500 is approximately constant.

The relative sizes of the test pipe 510 and the in-line mixer 120 affect the mixing performance once the proppant slurry 210 emerges from the plurality of slots 126 (FIG. 2B). A gap G, defined as the annular space between the inner wall of the test pipe 510 and the outer surface of the in-line mixer 120, and a length L2, similar to the length L1 described with respect to FIG. 2B, are visible through the clear test pipe 510. In this embodiment of the in-line mixer 120, the end cap 127 has a reduced diameter tip 138 and L2 is determined by the transition in diameters.

Figure 6A:
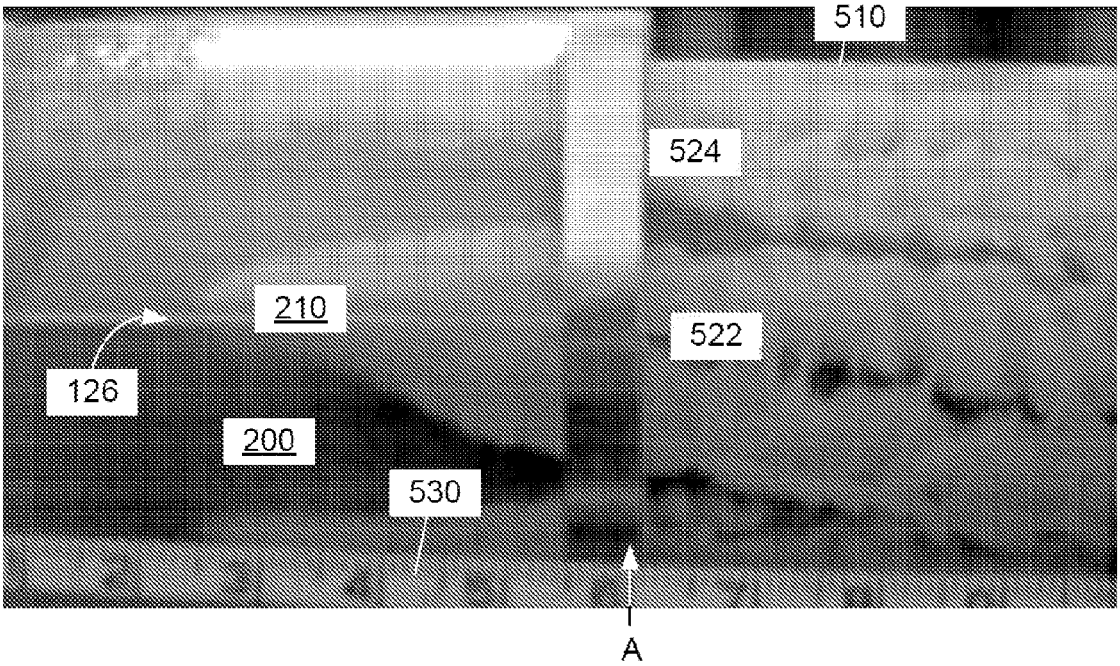
FIGS. 6A-6C are photographs of the fluid flowing through the test system of FIG. 5 at various distances from the exemplary in-line mixer, according to one or more embodiments.
Figure 6B:
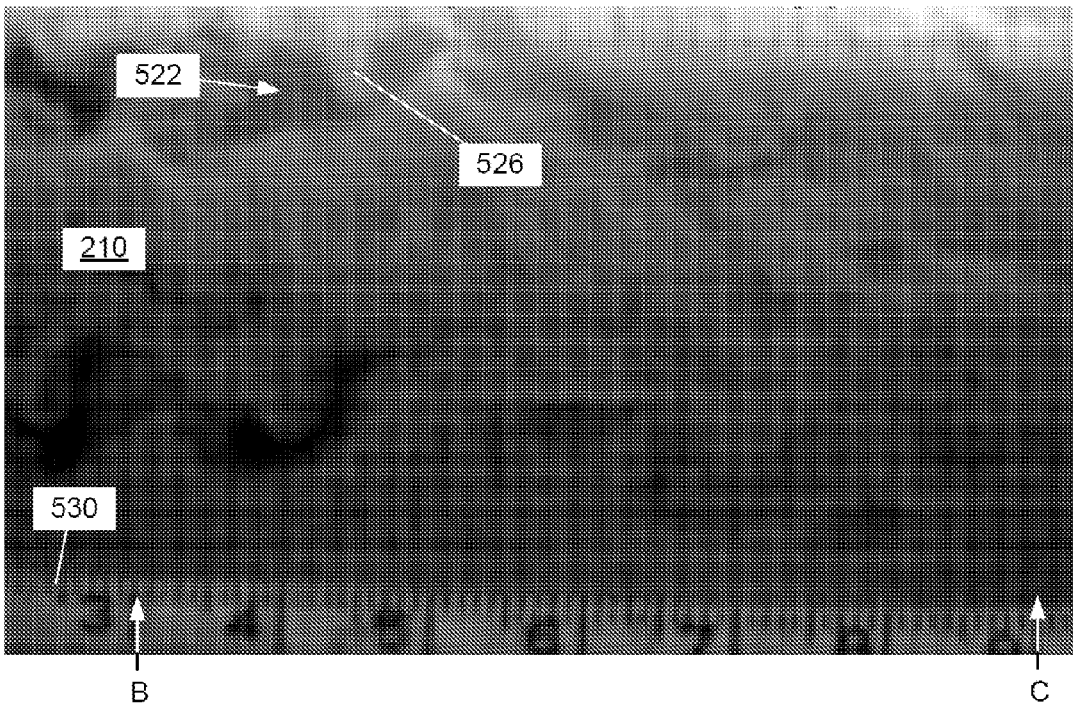
Figure 6C:
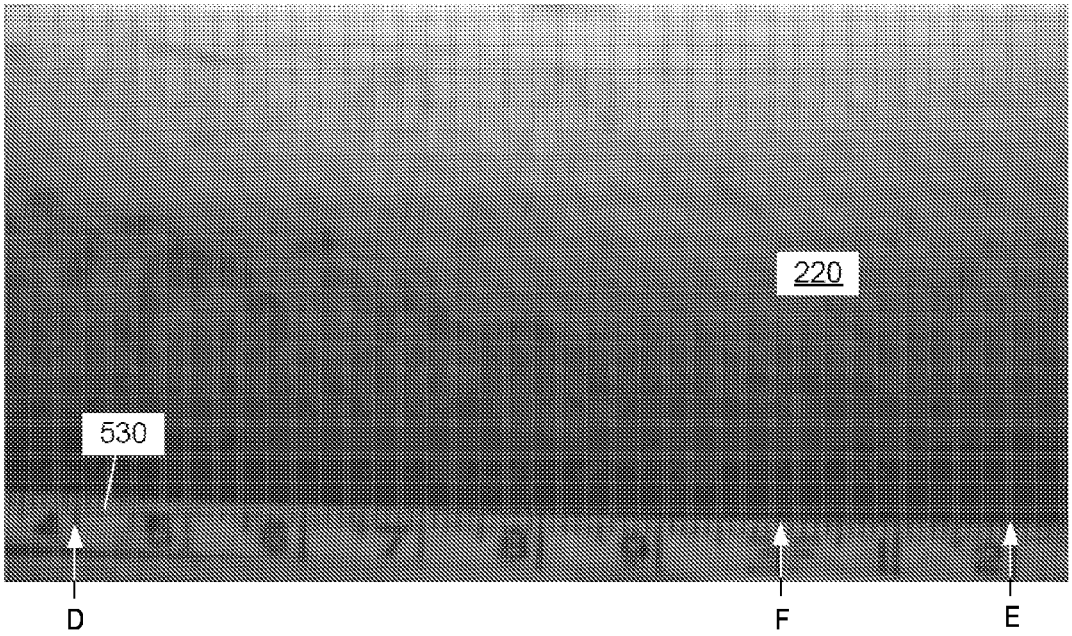

FIGS. 6A-6C are photographs of the fluid flowing through the test system 500 of FIG. 5 at various measured distances from the in-line mixer 120, according to one or more embodiments. A clear clean fluid 200 is flowing from left to right in the test system 500. Proppant slurry 210, visible as a grey liquid, is flowing out of the slots 126 and being carried to the right by the flowing clean fluid 200. A tape measure 530 that is marked in tenths of a foot, further subdivided into hundredths of a foot, is positioned alongside the test pipe 510 and visible at the bottom of FIG. 6A. The upstream edge of the slots 126 are located approximately at a location along the test pipe 500 that is aligned with the 0.3-foot mark, an arbitrary location, on the tape measure 530.

It can be seen that the initial unitary flow of the proppant slurry 210 emerging from the slots 126 bifurcates by the time it reaches the position associated with arrow "A" at approximately the 0.6 foot position, indicated by the separation 522, and each of the bifurcated flows is undergoing further secondary separation 524. Without being bound by theory, this mixing may be accomplished by one or more of the difference in viscosity and density of the proppant slurry 210 and the clean fluid 200, vortices created by the impingement of the jets of proppant slurry 210 on the walls of the test pipe 510, a difference in velocity between the emerging jet of the proppant slurry 210 and the main flow of the clean fluid 200, and a velocity profile between the in-line mixer 120 and the wall of the test pipe 510 that is associated with a boundary layer of the clean fluid 200 along one or both of the in-line mixer 120 and the wall of the test pipe 510.

FIG. 6B depicts the visible flow within the test pipe 510 between the positions associated with arrows "B" and "C" at approximately the 2.3 and 2.9 feet positions, respectively, of the tape measure 530. The separations 522 are intermixing with the flows of proppant slurry 210 as vortices 526 and other local circulation effects disturb the overall left-to-right flow.

FIG. 6C depicts the visible flow within the test pipe 510 between the positions associated with arrows "D" and "E" at approximately the 2.4 and 3.2 feet positions, respectively, of the tape measure 530. This overlaps the view of FIG. 6B and it can be seen that the intermixing of the proppant slurry 210 and the clean fluid 200 is substantially complete as the flow reaches the position associated with arrow "F" at approximately the 3.0 foot marker. To the right of the 3.0-foot marker, the concentration of the liquid within the test pipe 510 can be considered generally uniform. Thus, the above-described testing shows that the mixing of the proppant slurry 210 and the clean fluid 200 is substantially complete within a few feet of the in-line mixer 120, which may considered essentially instantaneous compared to a depth of 10,000 feet or more.

Embodiments disclosed herein include:

A. A method of providing a step-change in proppant concentration includes connecting an in-line mixer at an end of a conveyance, placing the in-line mixer within a conduit, providing a flow of a clean fluid from an upper portion of the conduit past the in-line mixer and into a lower portion of the conduit, introducing a proppant slurry into the conveyance, and injecting the proppant slurry into the clean fluid from the in-line mixer to generate a mixture of the proppant slurry and the clean fluid, wherein the mixture exhibits a first step-change from the clean fluid to a flow of the mixture in the lower portion of the conduit.

B. Another method of providing a step-change in proppant concentration includes connecting an in-line mixer at an end of a conveyance, placing the in-line mixer within a casing string that is disposed within a wellbore such that the in-line mixer is proximate to a production zone, providing a flow of a clean fluid from an upper portion of the casing string past the in-line mixer and into a lower portion of the casing string, introducing a proppant slurry into the conveyance, and injecting the proppant slurry into the clean fluid from the in-line mixer to generate a mixture of the proppant slurry and the clean fluid, wherein the mixture exhibits a first step-change from the clean fluid to a flow of the mixture in the lower portion of the casing string.

C. A method includes connecting an in-line mixer at an end of a conveyance, placing the in-line mixer within a conduit proximate to a desired location, providing a flow of a clean fluid from an upper portion of the conduit past the in-line mixer and into a lower portion of the conduit, introducing a proppant slurry into the conveyance, and injecting the proppant slurry into the clean fluid from the in-line mixer to generate a first step-change from the clean fluid to a flow of a mixture of the proppant slurry and the clean fluid within the desired location.

Each of embodiments A, B, and C may have one or more of the following additional elements in any combination: Element 1: further comprising stopping injection of the proppant slurry into the clean fluid such that a second step-change results from the mixture to the clean fluid in the lower portion of the conduit. Element 2: wherein injecting the proppant slurry into the clean fluid creates a slug of the mixture of the proppant slurry and the clean fluid in the lower portion of the conduit. Element 3: further comprising injecting the slug of the mixture into a subterranean formation. Element 4: wherein the in-line mixer is disposed within the conduit proximate to a source of the clean fluid. Element 5: wherein the in-line mixer is disposed on a mobile platform carrying the source of the clean fluid. Element 6: wherein the in-line mixer is disposed within the conduit proximate to a wellhead installation. Element 7: wherein the proppant slurry includes at least 12 pounds of a granular solid per gallon of proppant slurry. Element 8: wherein the clean fluid includes solid particulates suspended therein, the solid particulates being different that the proppant slurry.

Element 9: further comprising circulating the clean fluid into the production zone through one or more penetrations defined in the lower portion of the casing string, hydraulically fracturing the production zone with the clean fluid, and circulating the mixture at the first step change into the production zone and thereby pillar fracturing the production zone. Element 10: further comprising stopping injection of the proppant slurry into the clean fluid such that a second step-change results from the mixture to the clean fluid in the lower portion of the conduit, and circulating the clean fluid into the production zone at the second step-change. Element 11: wherein the proppant slurry includes at least 12 pounds of a granular solid per gallon of proppant slurry.

Element 12: wherein the desired location is at a wellhead installation. Element 13: wherein the desired location is at an opening to a fracture in a subterranean formation. Element 14: wherein the desired location comprises a plurality of locations within a wellbore. Element 15: further comprising the step of changing a flow rate of the proppant slurry through the conveyance so as to generate a second step-change in a concentration of proppant within the mixture of the proppant slurry and the clean fluid within the desired location. Element 16: wherein the second step change is a decrease in proppant concentration. Element 17: wherein changing a flow rate comprises stopping the flow of proppant slurry. Element 18: wherein the second step change is an increase in proppant concentration.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of providing a step-change in proppant concentration, the method comprising:

connecting an in-line mixer at an end of a conveyance;

placing the in-line mixer within a conduit;

providing a flow of a clean fluid from an upper portion of the conduit past the in-line mixer and into a lower portion of the conduit;

introducing a proppant slurry into the conveyance; and injecting the proppant slurry into the clean fluid from the in-line mixer to generate a mixture of the proppant slurry and the clean fluid, wherein the mixture exhibits a first step-change from the clean fluid to a flow of the mixture in the lower portion of the conduit.

2. The method of claim 1, further comprising:

stopping injection of the proppant slurry into the clean fluid such that a second step-change results from the mixture to the clean fluid in the lower portion of the conduit.

3. The method of claim 2, wherein injecting the proppant slurry into the clean fluid creates a slug of the mixture of the proppant slurry and the clean fluid in the lower portion of the conduit.

4. The method of claim 3, further comprising injecting the slug of the mixture into a subterranean formation.

5. The method of claim 1, wherein the in-line mixer is disposed within the conduit proximate to a source of the clean fluid.

6. The method of claim 5, wherein the in-line mixer is disposed on a mobile platform carrying the source of the clean fluid.

7. The method of claim 1, wherein the in-line mixer is disposed within the conduit proximate to a wellhead installation.

8. The method of claim 1, wherein the proppant slurry includes at least 12 pounds of a granular solid per gallon of proppant slurry.

9. The method of claim 1, wherein the clean fluid includes solid particulates suspended therein, the solid particulates being different that the proppant slurry.

10. A method of providing a step-change in proppant concentration, the method comprising:

connecting an in-line mixer at an end of a conveyance;

placing the in-line mixer within a casing string that is disposed within a wellbore such that the in-line mixer is proximate to a production zone;

providing a flow of a clean fluid from an upper portion of the casing string past the in-line mixer and into a lower portion of the casing string;

introducing a proppant slurry into the conveyance; and injecting the proppant slurry into the clean fluid from the in-line mixer to generate a mixture of the proppant slurry and the clean fluid, wherein the mixture exhibits a first step-change from the clean fluid to a flow of the mixture in the lower portion of the casing string.

11. The method of claim 10, further comprising:

circulating the clean fluid into the production zone through one or more penetrations defined in the lower portion of the casing string;

hydraulically fracturing the production zone with the clean fluid; and circulating the mixture at the first step change into the production zone and thereby pillar fracturing the production zone.

12. The method of claim 11, further comprising:

stopping injection of the proppant slurry into the clean fluid such that a second step-change results from the mixture to the clean fluid in the lower portion of the conduit; and circulating the clean fluid into the production zone at the second step-change.

13. The method of claim 10, wherein the proppant slurry includes at least 12 pounds of a granular solid per gallon of proppant slurry.

14. A method comprising:

connecting an in-line mixer at an end of a conveyance;

placing the in-line mixer within a conduit proximate to a desired location;

providing a flow of a clean fluid from an upper portion of the conduit past the in-line mixer and into a lower portion of the conduit;

introducing a proppant slurry into the conveyance; and injecting the proppant slurry into the clean fluid from the in-line mixer to generate a first step-change from the clean fluid to a flow of a mixture of the proppant slurry and the clean fluid within the desired location.

15. The method of claim 14, wherein the desired location is at a wellhead installation.

16. The method of claim 14, wherein the desired location is at an opening to a fracture in a subterranean formation.

17. The method of claim 14, wherein the desired location comprises a plurality of locations within a wellbore.

18. The method of claim 14, further comprising the step of:

changing a flow rate of the proppant slurry through the conveyance so as to generate a second step-change in a concentration of proppant within the mixture of the proppant slurry and the clean fluid within the desired location.

19. The method of claim 18, wherein the second step change is a decrease in proppant concentration.

20. The method of claim 19, wherein changing a flow rate comprises stopping the flow of proppant slurry.

21. The method of claim 18, wherein the second step change is an increase in proppant concentration.

* * * * *